US005364477A

United States Patent [19]

Ramanan et al.

[11] Patent Number: 5,364,477

[45] Date of Patent: Nov. 15, 1994

[54] IRON RICH METALLIC GLASSES HAVING HIGH SATURATION INDUCTION AND SUPERIOR SOFT FERROMAGNETIC PROPERTIES AT HIGH MAGNETIZATION RATES

[75] Inventors: V. R. V. Ramanan, Dover; Carl H. Smith, Chatham, both of N.J.

[73] Assignee: AlliedSignal Inc., Morristown, N.J.

[21] Appl. No.: 995,563

[22] Filed: Dec. 23, 1992

Related U.S. Application Data

[63] Continuation of Ser. No. 880,310, May 5, 1992, abandoned, which is a continuation of Ser. No. 710,232, Jun. 3, 1991, abandoned, which is a continuation of Ser. No. 469,667, Jan. 24, 1990, abandoned, which is a continuation-in-part of Ser. No. 379,763, Jul. 14, 1989, abandoned.

[51] Int. Cl.[5] ..... H01F 1/04

[52] U.S. Cl. ..... 148/304; 420/99; 420/117; 420/121

[58] Field of Search ..... 148/304, 403; 420/99, 420/117, 121

[56] References Cited

U.S. PATENT DOCUMENTS 3,940,293 2/1976 Polk et al. ..... 148/403

4,321,090 3/1982 Datta et al. ..... 148/304

FOREIGN PATENT DOCUMENTS 55-152150 11/1980 Japan ..... 148/304

*Primary Examiner*—John P. Sheehan

*Attorney, Agent, or Firm*—Ernest D. Buff; Roger H. Criss

[57] ABSTRACT

A magnetic metallic glass alloy exhibits, in combination, high saturation induction and low magnetic anisotropy energy. The alloy has a composition described by the formula $Fe_aCo_bB_cSi_dC_e$, where "a"–"e" are in atom percent, "a" ranges from about 72 to about 84, "b" ranges from about 2 to about 8, "c" ranges from about 11 to about 16, "d" ranges from about 1 to about 4, and "e" is zero or ranges from about 3 to about 4, with up to about 1 atom percent of Mn being optionally present in the alloy, with the provisos that (i) when "e" is zero and "a" is greater than or equal to 80, "b" cannot exceed 4, (ii) when "e" is zero and "a" is less than 80 by an amount x, "b" cannot exceed (4+4x) and, (iii) the sum ("a"+"b"+"c"+"d"+"e") equals 100. Such an alloy is especially suited for use in large magnetic cores associated with pulse power applications requiring high magnetization rates. Examples of such applications include high power pulse sources for linear induction particle accelerators, induction modules for coupling energy from the pulse source to the beam of these accelerators, magnetic switches in power generators in inertial confinement fusion research, magnetic modulators for driving excimer lasers, and the like.

7 Claims, 1 Drawing Sheet

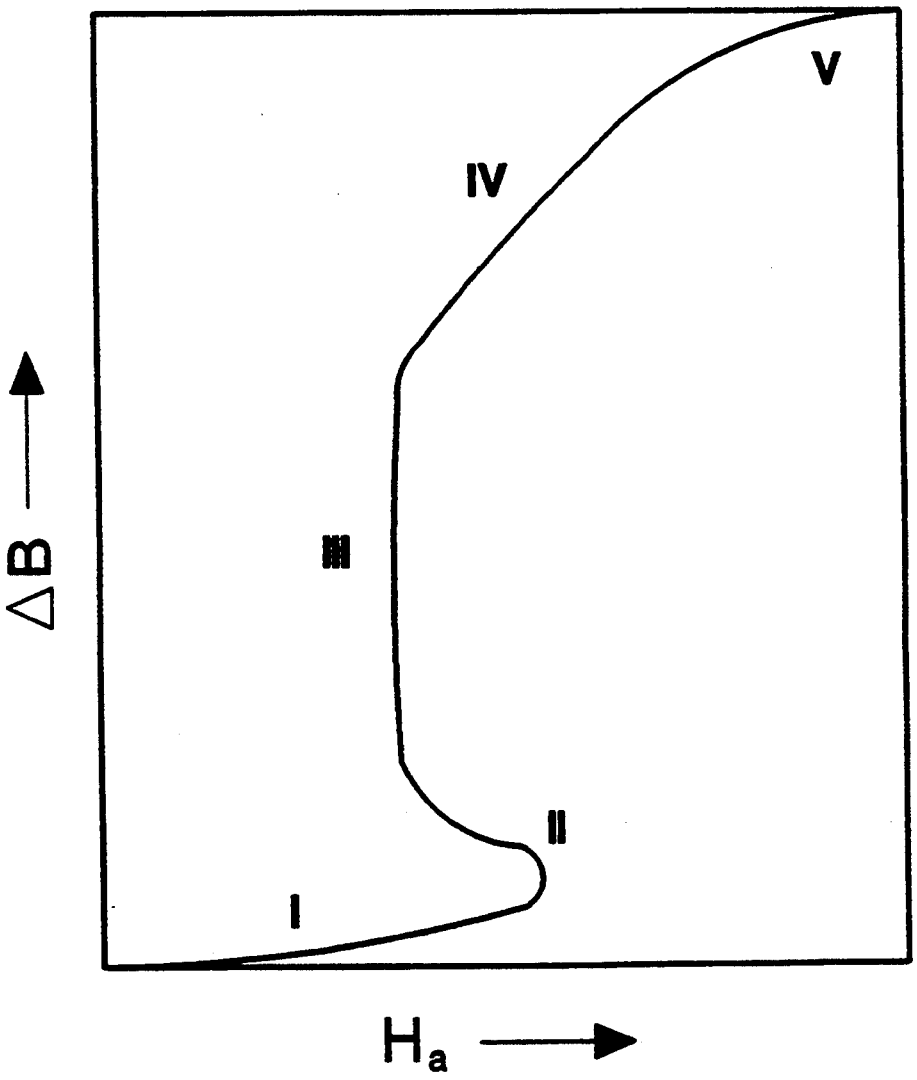
V
IV
III
II
I
ΔB
Ha

IRON RICH METALLIC GLASSES HAVING HIGH SATURATION INDUCTION AND SUPERIOR SOFT FERROMAGNETIC PROPERTIES AT HIGH MAGNETIZATION RATES

CROSS REFERENCE TO RELATED APPLICATIONS

This application is a continuation of application Ser. No. 880,310 filed May 5, 1992 now abandoned which, in turn, is a continuation of U.S. Ser. No. 710,232, filed Jun. 3, 1991 which, in turn, is a continuation of U.S. Ser. No. 469,667, filed Jan. 24, 1990 now abandoned, which in turn is a continuation-in-part of U.S. application Ser. No. 379,763, filed Jul. 14, 1989 now abadoned.

BACKGROUND OF THE INVENTION

1. Field of the Invention

This invention relates to iron-rich metallic glass alloys having high saturation induction that evidence particularly superior soft ferromagnetic properties when subjected to high magnetization rates.

2. Description of the Prior Art

Glassy metal alloys (metallic glasses) are metastable materials lacking any long range order. They are conveniently prepared by rapid quenching from the melt using processing techniques that are conventional in the art. Examples of such metallic glasses and methods for their manufacture are disclosed in U.S. Pat. Nos. 3,856,513, 4,067,732 and 4,142,571. The advantageous soft magnetic characteristics of metallic glasses, as disclosed in these patents, have been exploited in their wide use as materials in a variety of magnetic cores, such as in distribution transformers, switch-mode power supplies, tape recording heads and the like.

Applications for soft magnetic cores, in a particular class that is now receiving increased attention, are generically referred to as pulse power applications. In these applications, a low average power input, with a long acquisition time, is converted to an output that has high peak power delivered in a short transfer time. In the production of such high power pulses of electrical energy, very fast magnetization reversals, ranging up to 100 T/μs (or 100 MT/s), occur in the core materials. Examples of pulse power applications include saturable reactors for magnetic pulse compression and for protection of circuit elements during turn on, and pulse transformers in linear induction particle accelerators.

Metallic glasses are very well suited for pulse power applications because of their high resistivities and thin ribbon geometry, which allow low losses under fast magnetization reversals. (See, for example, (i) "Metallic Glasses in High-Energy Pulsed-Power Systems", by C. H. Smith, in *Glass . . . Current Issues*, A. J. Wright and J. Dupuy, eds., (NATO ASI Series E, No. 92, Martinus Nijhoff Pub., Dordrecht, The Netherlands, 1985) pp. 188–199.) Furthermore, metallic glasses, due to their noncrystalline nature, bear no magneto-crystalline anisotropy and, consequently, may be annealed to deliver very large flux swings, with values approaching the theoretical maximum value of twice the saturation induction of the material, under rapid magnetization rates. These advantageous aspects of metallic glass materials have led to their use as core materials in various pulse power applications: in high power pulse sources for linear induction particle accelerators, as induction modules for coupling energy from the pulse source to the beam of these accelerators, as magnetic switches in power generators, in inertial confinement fusion research, and in magnetic modulators for driving excimer lasers.

In a typical pulse power application, the core material is initially "parked" in, or biased into, a specific magnetic state through the imposition of appropriate external magnetic fields. For example, the application of a large, negative d.c. field will place the core material in a negatively saturated state. (The direction in which the core material will be driven into saturation during the application is referred to as the positive direction.) A subsequent removal of this field will position the core material at negative remanence. The former procedure allows for a maximum flux swing of twice the saturation induction in the core material but, as a matter of convenience, the latter procedure, known as the pulse reset, is most commonly employed. The maximum flux swing is then the sum of the remanent and saturation inductions. Henceforth, unless otherwise specified, the term "maximum flux swing", as used herein, connotes a value that is determined by the sum of the remanent and saturation inductions. Metallic glasses may easily be annealed to yield a value for $B_r$, the remanent induction, that is very close to $B_s$, the saturation induction. The input that is to be compressed, or transformed, in the application, is then applied to the core material.

Most pulse power applications require a high saturation induction in the core material, which leads to a large flux swing in the core. The core material should, preferably, also possess a low induced magnetic anisotropy energy. A low magnetic anisotropy energy leads to lower core losses, by facilitating the establishment of an optimal ferromagnetic domain structure, and therefore allow the cores to operate with greater efficiency. METGLAS® 2605CO (nominal composition: $Fe_{66}Co_{18}B_{15}Si_1$), available from Allied-Signal Inc., is a high induction metallic glass alloy currently used in many of the pulse power applications recited above. This metallic glass is taught by U.S. Pat. No. 4,321,090, wherein metallic glasses having a high saturation induction are disclosed. The saturation induction of this glassy alloy is about 1.75 T. However, the high cobalt content in this alloy imparts a high value for the magnetic anisotropy energy and, consequently, high core losses. The value of about 900 J/m$^3$ for the magnetic anisotropy energy in this alloy is among the highest obtained in metallic glasses. In spite of its high induction, a maximum flux swing of only about 3.2 T is attainable from this alloy. Furthermore, the high Co content in this alloy leads to high raw material costs. Considering that the cores used in pulse power applications may contain as much as 100 kg of core material per core, and considering that Co had been classified as a strategic material, a more economical alloy containing substantially reduced levels of Co is highly desirable.

A metallic glass alloy that contains no cobalt is METGLAS® 2605SC (nominal composition: $Fe_{81}B_{13.5}Si_{3.5}C_2$), available from Allied-Signal Inc. This alloy is disclosed in U.S. Pat. No. 4,219,355. The low magnetic anisotropy energy (about 100 J/m$^3$) of this alloy has been exploited in certain pulse power applications. However, the lower saturation induction (about 1.57 T) and a correspondingly lower maximum flux swing (about 2.9 T) available from this alloy have deterred widespread use of this alloy in pulse power applications.

A metallic glass alloy that offered a combination of high induction (large flux swings) and low magnetic anisotropy energy would be highly desirable for the purpose of pulse power applications. An additional advantage would be derived if such an alloy were to offer economy in production costs.

SUMMARY OF THE INVENTION

The present invention provides iron-rich magnetic alloys that are at least about 80% glassy and are characterized by a combination of high saturation induction and low magnetic anisotropy energy. Generally stated, the glassy metal alloys of the invention have a composition described by the formula $Fe_aCo_bB_cSi_dC_e$, where "a"–"e" are in atom percent, "a" ranges from about 72 to about 84, "b" ranges from about 2 to about 8, "c" ranges from about 11 to about 16, "d" ranges from about 1 to about 4, and "e" is zero or ranges from about 3 to about 4, with the provisos that (i) when "e" is zero and "a" is greater than or equal to 80, "b" cannot exceed 4, (ii) when "e" is zero and "a" is less than 80 by an amount x, "b" cannot exceed (4+4x) and, (iii) the sum ("a"+"b"+"c"+"d"+"e") equals 100. These alloys may, optionally, contain up to about 1 atom percent of Mn. The metallic glasses of the invention, when suitably annealed, additionally evidence large values for the dc swing from negative remanence to positive saturation. In the alloys of the invention, the saturation induction ranges from about 1.55 T to about 1.75 T, the magnetic anisotropy energy ranges between about 300 $J/m^3$ and 400 $J/m^3$, and the above mentioned dc swing typically ranges from about 2.9 T to about 3.2 T.

The metallic glasses of this invention are especially suitable for use in large magnetic cores used in various pulse power applications requiring high magnetization rates. Representative of such applications are high-power pulse sources for linear induction particle accelerators, induction modules for coupling energy from the pulse source to the beam of these accelerators, magnetic switches in power generators in inertial confinement fusion research and magnetic modulators for driving excimer lasers. Other uses include cores of airborne transformers, current transformers, ground fault interrupters, switch-mode power supplies, and the like.

BRIEF DESCRIPTION OF THE DRAWINGS

The invention will be more fully understood and further advantages will become apparent when reference is made to the following detailed description of the preferred embodiments of the invention and the accompanying drawing in which is provided a schematic representation of the dynamic magnetization curve obtained when a ferromagnetic material is subjected to very high magnetization rates, wherein $H_a$ is the applied field and $\Delta B$ is the total change in induction.

DESCRIPTION OF THE PREFERRED EMBODIMENTS

In accordance with the present invention, there are provided iron-rich magnetic metallic glass alloys that are at least about 80% glassy and are characterized by a combination of high saturation induction and low magnetic anisotropy energy. Generally stated, the glassy metal alloys of the invention have a composition described by the formula $Fe_aCo_bB_cSi_dC_e$, where "a"–"e" are in atom percent, "a" ranges from about 72 to about 84, "b" ranges from about 2 to about 8, "c" ranges from about 11 to about 16, "d" ranges from about 1 to about 4, and "e" is zero or ranges from about 3 to about 4, with the provisos that (i) when "e" is zero and "a" is greater than or equal to 80, "b" cannot exceed 4, (ii) when "e" is zero and "a" is less than 80 by an amount x, "b" cannot exceed (4+4×) and, (iii) the sum ("a"+"b"+"c"+"d"+"e") equals 100. These alloys may, optionally, contain up to about 1 atom percent of Mn. The purity of the above compositions is that found in normal commercial practice. The metallic glasses of the invention, when suitably annealed, additionally evidence large values for the dc swing from negative remanence to positive saturation. In the alloys of the invention, the saturation induction ranges from about 1.55 T to about 1.75 T, the magnetic anisotropy energy ranges between about 300 $J/m^3$ and 400 $J/m^3$, and the above mentioned dc swing typically ranges from about 2.9 T to about 3.2 T.

Since the presence of even small fractions of crystallinity in an otherwise glassy alloy tends to impair the optimal soft magnetic performance of the alloy, the alloys of the invention are preferably at least 90% glassy, and most preferably 100% glassy, as established by X-ray diffraction. Furthermore, the glassy alloys of the invention that evidence a saturation induction of at least about 1.6 T are to be especially preferred from the point of view of pulse power applications.

Examples of metallic glasses of the invention include $Fe_{78}Co_8B_{11}Si_3$, $Fe_{81}Co_2B_{14}Si_3$, $Fe_{84}Co_2B_{13}Si_1$, $Fe_{79}Co_6B_{12}Si_3$, $Fe_{78}Co_6B_{12}Si_1C_3$, $Fe_{76}Co_7B_{12}Si_2C_3$, $Fe_{78}Co_2B_{14}Si_2C_4$, $Fe_{77}Co_6B_{12}Si_2C_3$, and $Fe_{78}Co_6B_{12}Si_3Mn_1$.

The importance of a high saturation induction in an alloy targeted for use in pulse power applications, such as a magnetic switch, may be understood as follows: Given that the units for saturation induction are volt-second per meter squared ($Vs/m^2$), [1 ($Vs/m^2$)=1 T], a magnetic core of a given cross-sectional area will "hold off" a known amount of Vs from the output. Therefore, under a fixed input voltage level, the hold-off time is greater when the core material has a greater saturation induction.

The presence of Co in the alloys serves to increase the saturation induction level. Cobalt contents of less than about 2 at. % provide only marginal increases in saturation induction levels over alloys containing no cobalt. The rate of increase of saturation induction due to the presence of Co reduces substantially above a certain maximum level for Co, a level which seems to be a function of the iron content in the alloy; the lower the Fe content, the higher is the maximum Co content. Specifically, it has been found that when the Fe content of the alloy is at or above 80 atomic percent, this maximum level for Co is about 4 atomic percent. Above this level of Co in such alloys, there is a negligible effect on the saturation induction. Higher levels of Co are, therefore, not desired because of the substantial cost of the element. It has also been found that as the Fe content is reduced below 80 atomic percent, the Co level may be increased in the alloy by an amount that is four times the extent of reduction in the iron content, before the beneficial effects of Co on the saturation induction level are muted. In other words, for each atom percent reduction in iron from 80, the maximum Co level may increase by 4 atom percent.

The alloys of the invention that contain carbon are preferred alloys of the invention, for a variety of reasons: First, the introduction of C in the alloys has been found to increase even further the saturation induction levels of the alloys. It has been found that the rate of increase of the saturation induction level due to additions of C slowed above about 2 at. % C. The data in Table I serve to illustrate the effects of C on the saturation induction of the alloys of the invention.

TABLE I

Data showing the beneficial effects of C on the saturation induction, $B_s$, of the alloys of this invention.

| Composition (at. %) | $B_s$ (T) |
|---|---|
| $Fe_{79}Co_6B_{12}Si_3$ | 1.66 |
| $Fe_{77}Co_6B_{14}Si_3$ | 1.64 |
| $Fe_{81}Co_2B_{14}Si_3$ | 1.60 |
| $Fe_{76}Co_6B_{12}Si_3C3$ | 1.71 |
| $Fe_{75}Co_6B_{12}Si_3C_4$ | 1.64 |
| $Fe_{74}Co_6B_{14}Si_3C_3$ | 1.66 |

The second reason for requiring the presence of C in the preferred alloys of the invention is that the handling characteristics of an iron-rich alloy melt are improved with the introduction of C in the melt. From the point of view of large scale production of rapidly solidified ribbons of metallic glasses, improved handling characteristics of the alloy melt are an important asset. The maximum amount of about 4 at. % for C in the alloys of the invention offers an acceptable compromise between the loss of saturation induction levels and the improvements in melt handling characteristics. Since improve melt handling characteristics are a critical factor in large scale, economic production of commercial alloys, the alloys of the invention that contain between about 3 and about 4 atom percent C are especially preferred alloys of the invention. It will be noted from Table I that the saturation induction of an alloy with 4 at. % C is approximately the same as in an alloy without any carbon.

It is further believed that the presence of C in the alloys of the invention helps to reduce the magnetic anisotropy energy of the alloys. This is another reason for preferring high C levels in the alloys of the invention. The magnetic anisotropy energy of a ferromagnetic material is a measure of the energy required to rotate the magnetic moments in the material away from an established, preferred direction of alignment. The magnitude of this energy dictates the ease with which a particular domain structure may be established in the material.

The importance of a low magnetic anisotropy energy, and the consequent reduction of core losses, in an alloy targeted for use in pulse power applications is illustrated in the Figure. This figure is a schematic representation of the dynamic magnetization curves ("B—H loops") obtained from ferromagnetic materials which are subjected to high magnetization rates; $H_a$ is the applied magnetic field on the core material and $\Delta B$ is the flux swing obtained from the core material. As noted in the figure, this magnetization curve may be broken down to five regions (or parts) of magnetic response from the core material.

In region I, after a rapid increase usually limited by stray inductances, $H_a$ reaches a maximum and then actually decreases in many cases. This peak in region II is associated with the establishment of bar shaped ferromagnetic domains spanning the ribbon thickness, the minimum in H corresponding to the attainment of an efficient domain wall spacing. Magnetization progresses by the motion of these bar domain walls in region III, costing very little in $H_a$. Towards the end of region III, the higher mobility of the portion of the domain walls near the ribbon surface soon results in a single domain wall which encircles the interior of the ribbon, and is generally referred to as the "sandwich" domain. While no detailed understanding is available, it is generally understood in the art that the magnetization behavior in region IV is related to the progression of this sandwich domain, before saturation is attained in region V.

The area enclosed by the dynamic magnetization curve and the ordinate axis in the Figure represents the core loss of the magnetic core material. This core loss is really a "half-cycle" loss, in that only one-half of a conventional hysteresis loop is being traversed by the material. Henceforth, all references to core losses of materials, whether of this invention or not, in connection with the description of this invention will imply these half-cycle losses.

It is clear from the Figure that the core loss may be reduced if the efficiency of establishment of the bar domains is improved upon, i.e., if the "knee" in region II is shortened. Since this efficiency is directly related to the ferromagnetic anisotropy energy, an alloy targeted for use in pulse power applications should preferably have a low magnetic anisotropy energy.

It is well understood in the art that the magnetic anisotropy energy of metallic glasses in the Fe—B—Si system may be reduced by the addition of suitable amounts of a fourth element. As mentioned above, carbon is one such element. Examples of other such elements include Mo, Nb, V, and Cr.

It has been unexpectedly found, however, that, in the Fe—Co—B—Si system of metallic glasses, C is the only elemental addition that increases the saturation induction level of the "parent" alloy. All other attempted elemental additions reduce the saturation induction by substantial amounts. Table II illustrates these findings. For these reasons, the various elemental additions listed in Table II, except for carbon, should be excluded from a metallic glass alloy targeted for use in magnetic cores of applications, such as pulse power applications, which demand high saturation induction levels in the core material.

TABLE II

Data illustrating that, except for carbon, additional elements introduced to Fe—Co—B—Si metallic glasses have deleterious effects on saturation induction. In this Table, the first two named alloys are metallic glasses belonging to this invention, while all other named alloys fall outside the scope of this invention.

| Composition (at. %) | $B_s$ (T) |
|---|---|
| $Fe_{77}Co_6B_{14}Si_3$ | 1.64 |
| $Fe_{74}Co_6B_{14}Si_3C_3$ | 1.66 |
| $Fe_{76}Co_6B_{14}Si_3Mo_1$ | 1.57 |
| $Fe_{75}Co_6B_{14}Si_3Mo_2$ | 1.49 |
| $Fe_{76}Co_6B_{14}Si_3Nb_1$ | 1.57 |
| $Fe_{75}Co_6B_{14}Si_3Nb_2$ | 1.48 |
| $Fe_{75}Co_6B_{14}Si_3V_2$ | 1.47 |
| $Fe_{75}Co_6B_{14}Si_3Cr_2$ | 1.47 |
| $Fe_{75}Co_6B_{14}Si_3Ti_2$ | 1.47 |
| $Fe_{75}Co_6B_{14}Si_3Zr_2$ | 1.47 |
| $Fe_{75}Co_6B_{14}Si_3Hf_2$ | 1.53 |
| $Fe_{75}Co_6B_{14}Si_3W_2$ | 1.53 |

The effect of Si in the alloys of the invention is to reduce the saturation induction but increase the thermal stability of the glassy state of the alloys by increasing their crystallization temperatures. The maximum level of about 4 at. % Si in the alloys of this invention defines an acceptable balance between these two effects of Si. Since higher thermal stability implies better long term performance of an alloy in an application, higher Si levels are to be desired. However, when C is present in an alloy of the invention, high Si levels are to be avoided, lest the beneficial increase in saturation induction due to C be compromised. In particular, alloys of the invention containing carbon and between about 1 and about 2 at. % silicon are another class of preferred alloys of the invention, wherein high saturation induction and good thermal stability are obtained in combination.

It is well known in the art that the core losses in a magnetic core may be reduced through the use of insulative coatings on the surfaces of the core material. Such is indeed the case also with cores prepared from the alloys of this invention. Depending on the materials and techniques employed, such coatings minimize or eliminate interlaminar electrical shorts in the core, leading to a reduction or elimination of the contribution to the total core loss from interlaminar eddy currents. Coated ribbons may conveniently be obtained by dipping as-cast ribbons in a diluted solution of colloidal silica. It should be apparent to one well versed in the art that various combinations of other coating techniques, such as spray coating or sputter coating, and other coating materials, such as magnesia or organic films such as Polyimide, may also be employed to achieve reductions in the core loss of the materials of this invention. Similarly, it would also be apparent that, depending on the coating material, the ribbon may be annealed prior to being coated.

The following examples are presented to provide a more complete understanding of the invention. The specific techniques, conditions and reported data set forth to illustrate the principles and practice of the invention are exemplary and should not be construed as limiting the scope of the invention. All alloy compositions described in the examples are nominal compositions.

EXAMPLES

Glassy metal alloys, designated as samples no. 1 to 30 in Table III, were rapidly quenched from the melt following the techniques taught by Narasimhan in U.S. Pat. No. 4,142,571, the disclosure of which is hereby incorporated by reference thereto. All casts were made in a vacuum chamber, using 0.025 to 0.100 kg melts comprising constituent elements of high purity. The resulting ribbons, typically 25 to 30 μm thick and about 6 mm wide, were determined to be free of crystallinity by x-ray diffractometry using Cu-$K_\alpha$ radiation and differential scanning calorimetry. Some of the alloys were also cast separately as 50 mm wide ribbons, to facilitate a direct comparison with commercial alloys. Each of the alloys was at least 80% glassy, most of them more than 90% glassy and, in many instances, the alloys were 100% glassy. Ribbons of these glassy metal alloys were strong, shiny, hard and ductile.

A commercial vibrating sample magnetometer was used for the measurement of the saturation magnetic moment of these alloys. As-cast ribbon from a given alloy was cut into several small squares (approximately 2 mm×2 mm), which were randomly oriented about a direction normal to their plane, their plane being parallel to a maximum applied field of about 755 kA/m. By using the measured mass density, the saturation induction, $B_s$, was then calculated. The density of many of these alloys was measured using standard techniques invoking Archimedes' Principle.

TABLE III

Values for saturation induction, $B_s$, obtained from various metallic glasses belonging to this invention.

| No. | | Fe—Co—B—Si—C—Mn | $B_s$ (T) |
|---|---|---|---|
| 1 | at. % | 84—2—13—1—0—0 | 1.60 (*) |
| | wt. % | 94.2—2.4—2.8—0.6—0—0 | |
| 2 | at. % | 81—2—14—3—0—0 | 1.60 |
| | wt. % | 92.8—2.4—3.1—1.7—0—0 | |
| 3 | at. % | 81—2—13.5—3.5—0—0 | 1.64 |
| | wt. % | 92.6—2.4—3.0—2.0—0—0 | |
| 4 | at. % | 80—4—13—3—0—0 | 1.59 |
| | wt. % | 90.7—4.8—2.9—1.7—0—0 | |
| 5 | at. % | 79—4—13.5—3.5—0—0 | 1.63 (*) |
| | wt. % | 90.2—4.8—3.0—2.0—0—0 | |
| 6 | at. % | 79—4—14—3—0—0 | 1.59 |
| | wt. % | 90.3—4.8—3.1—1.7—0—0 | |
| 7 | at. % | 79—6—12—3—0—0 | 1.66 |
| | wt. % | 88.6—7.1—2.6—1.7—0—0 | |
| 8 | at. % | 77—6—14—3—0—0 | 1.64 |
| | wt. % | 87.9—7.2—3.1—1.7—0—0 | |
| 9 | at. % | 76—6—15—3—0—0 | 1.65 |
| | wt. % | 87.6—7.3—3.3—1.7—0—0 | |
| 10 | at. % | 75—6—16—3—0—0 | 1.64 (*) |
| | wt. % | 87.3—7.4—3.6—1.8—0—0 | |
| 11 | at. % | 78—8—11—3—0—0 | 1.70 (*) |
| | wt. % | 86.6—9.4—2.4—1.7—0—0 | |
| 12 | at. % | 72—8—16—4—0—0 | 1.62 |
| | wt. % | 84.2—9.9—3.6—2.4—0—0 | |
| 13 | at. % | 78—2—14—3—3—0 | 1.59 |
| | wt. % | 91.8—2.5—3.2—1.8—0.8—0 | |
| 14 | at. % | 78—2—14—2—4—0 | 1.63 |
| | wt. % | 92.1—2.5—3.2—1.2—1.0—0 | |
| 15 | at. % | 77—2—14—3—4—0 | 1.56 |
| | wt. % | 91.5—2.5—3.2—1.8—1.0—0 | |
| 16 | at. % | 78—6—12—1—3—0 | 1.70 (**) |
| | wt. % | 88.8—7.2—2.6—0.6—0.7—0 | |
| 17 | at. % | 77—6—12—2—3—0 | 1.70 |
| | wt. % | 88.2—7.3—2.7—1.2—0.7—0 | |
| 18 | at. % | 76—6—12—3—3—0 | 1.65 |
| | wt. % | 87.5—7.3—2.7—1.7—0.7—0 | |
| 19 | at. % | 76—6—12—2—4—0 | 1.65 (**) |
| | wt. % | 87.8—7.3—2.7—1.2—1.0—0 | |
| 20 | at. % | 75—6—12—3—4—0 | 1.65 (**) |
| | wt. % | 87.2—7.4—2.7—1.8—1.0—0 | |
| 21 | at. % | 74—6—14—3—3—0 | 1.64 (**) |
| | wt. % | 86.9—7.4—3.2—1.8—0.8—0 | |
| 22 | at. % | 74—6—12—4—4—0 | 1.62 (**) |
| | wt. % | 86.5—7.4—2.7—2.4—1.0—0 | |
| 23 | at. % | 73—6—14—3—4—0 | 1.55 |
| | wt. % | 86.5—7.5—3.2—1.8—1.0—0 | |
| 24 | at. % | 73—6—15—3—3—0 | 1.60 |
| | wt. % | 86.5—7.5—3.4—1.8—0.8—0 | |
| 25 | at. % | 72—6—15—3—4—0 | 1.62 (**) |
| | wt. % | 86.1—7.6—3.5—1.8—1.0—0 | |
| 26 | at. % | 76—7—12—2—3—0 | 1.70 |
| | wt. % | 87.0—8.5—2.7—1.2—0.7—0 | |
| 27 | at. % | 75—7—12—2—4—0 | 1.66 (**) |
| | wt. % | 86.6—8.5—2.7—1.2—1.0—0 | |
| 28 | at. % | 80—2—14—3—0—1 | 1.57 (**) |
| | wt. % | 91.6—2.4—3.1—1.7—0—1.1 | |
| 29 | at. % | 78—6—12—3—0—1 | 1.60 |
| | wt. % | 87.5—7.1—2.6—1.7—0—1.1 | |
| 30 | at. % | 76—6—14—3—0—1 | 1.61 |
| | wt. % | 86.8—7.2—3.1—1.7—0—1.1 | |

(*) Assumed density of $7.3 \times 10^3$ (kg/m$^3$)
(**) Assumed density of $7.35 \times 10^3$ (kg/m$^3$)

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A magnetic metallic glass alloy that is at least about 80% glassy, having a composition consisting of the elements $Fe_aCo_bB_cSi_dC_e$, where "a"-"e" are in atom percent, "a" ranges from about 72 to about 84, "b" ranges from about 2 to about 8, "c" ranges from about 11 to about 16, "d" ranges from about 1 to about 4, and "e" ranges from about 3 to about 4, with the proviso that the sum ("a"+"b"+"c"+"d"+"e") equals 100.

2. The magnetic alloy of claim 1, wherein "d" ranges from about 1 to about 2.

3. The magnetic alloy of claim 1, wherein "c" ranges from about 11 to about 14.

4. The magnetic alloy of claim 2, wherein "c" ranges from about 11 to about 14.

5. A magnetic core adapted for use at magnetization rates greater than about 1 MT/s, said core having as its core material a metallic glass alloy that is at least about 80% glassy, and has a composition consisting of the elements $Fe_aCo_bB_cSi_dC_e$, where "a"–"e" are in atom percent, "a" ranges from about 72 to about 84, "b" ranges from about 2 to about 8, "c" ranges from about 11 to about 16, "d" ranges from about 1 to about 4, and "e" ranges from about 3 to about 4, with the proviso that the sum ("a"+"b"+"c"+"d"+"e") equals 100.

6. The magnetic core of claim 5, wherein said core material has the said "c" ranging between about 11 and about 14, and the said "d" ranging between about 1 and about 2.

7. The magnetic core of claim 5, wherein said core material has a composition selected from the group consisting of $Fe_{76}Co_7B_{12}Si_2C_3$, $Fe_{78}Co_6B_{12}Si_3$, $Fe_{78}Co_2B_{14}Si_2C_4$, and $Fe_{77}Co_6B_{12}Si_2C_3$.

* * * * *